United States Patent [19]

Esklavon et al.

[11] 4,122,367

[45] Oct. 24, 1978

[54] ELECTRIC INCANDESCENT LAMP HAVING A CENTERING RING

[75] Inventors: Peter Esklavon, Aachen; Georg Zander, Stolberg, both of Fed. Rep. of Germany; Jozef Goebbels, Kerkrade, Netherlands

[73] Assignee: U.S. Philips Corporation, New York, N.Y.

[21] Appl. No.: 762,108

[22] Filed: Jan. 24, 1977

[30] Foreign Application Priority Data

Feb. 12, 1976 [DE] Fed. Rep. of Germany ..... 2605433

[51] Int. Cl.[2] ..... H01J 5/48; H01J 5/50

[52] U.S. Cl. ..... 313/318; 339/119 L; 339/127 R

[58] Field of Search ..... 313/318; 339/119 L, 339/127 R, 176 L, 177 L, 182 L

[56] References Cited

U.S. PATENT DOCUMENTS

| | | | |
|---|---|---|---|
| 2,084,192 | 6/1937 | Cartun | 313/318 X |
| 3,473,015 | 10/1969 | Haas et al. | 339/127 R |
| 3,848,120 | 11/1974 | Wolfe et al. | 313/318 |
| 3,885,149 | 5/1975 | Wolfe et al. | 313/318 |

*Primary Examiner*—Saxfield Chatmon, Jr.
*Attorney, Agent, or Firm*—Frank R. Trifari; Robert S. Smith

[57] ABSTRACT

In an electric incandescent lamp having a metal cap and centering ring, hook-like side flaps are forced out of the side walls of the cap and engage via the flaps of the centering ring in slots in the centering ring. The assembly is fixed together by spot-welding.

4 Claims, 6 Drawing Figures

ELECTRIC INCANDESCENT LAMP HAVING A CENTERING RING

The invention relates to an electric incandescent lamp having a metal lamp cap which is rectangular in cross-section and which is fixed, by a thermal treatment, in a rectangular aperture in a metal centering ring between flaps which are forced out of said ring which is comparatively thick-walled as compared with the lamp cap.

In electric incandescent lamps which are used in optical systems, the position of the filament with respect to a given reference plane has such strict tolerances that said tolerances cannot be maintained with the usual lamp caps. Hence it is usual, for example, in headlight lamps or projection lamps that the lamp cap is first provided in the usual manner and the position of the filament to a centering ring is then accurately aligned optically on an aligning machine, after which the centering ring is fixed in this position to the lamp cap by means of a thermal treatment.

In the known incandescent lamps of this type the fixing is effected by soldering (German Pat. No. 1,489,413). In this case, however, the comparatively expensive optical aligning equipment cannot be used again until the soldering process is completed. Although in automatic optical alignment/soldering equipment the alignment time has been reduced to less than 1 second, the soldering time, however, is approximately 10 seconds, which hence largely determines the output rate of the alignment machine.

For this reason it has been endeavoured to replace the comparatively long soldering process by a short-duration welding operation.

In the known incandescent lamps having comparatively thin-walled metal lamp caps and comparatively thick-walled centering rings, the cap is constructed smooth and the flaps projecting from the centering ring engage the cap on the outside. In spot-welding the flaps to the cap the welding electrodes would engage the comparatively thick-walled centering ring, whereas the comparatively thin-walled cap forms the mass terminal. However, this may lead to destruction of the cap.

It is the object of the invention to provide an electric incandescent lamp of the kind mentioned in the preamble in which the lamp cap and the centering ring can more reliably be connected together by welding, in particular by spot-welding.

According to the invention, this object is achieved in that hook-like side flaps are forced out of two opposing side walls of the cap and engage via the flaps of the centering ring in slots in the centering ring and are fixed in this position to the flaps of the centering ring by spot-welding.

In this manner it is achieved that the side flaps of the comparatively thin-walled caps engage the flaps of the comparatively thick-walled centering ring at the outer side. With such an arrangement of the parts which are to be connected together a perfect spot-welded joint can be achieved.

The slots in the centering ring preferably adjoin the flaps of the centering ring.

The invention will now be described in greater detail with reference to an example shown in the drawing.

Figure 1:
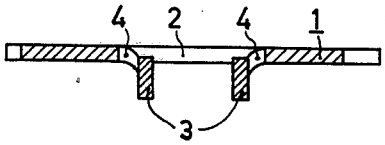
FIGS. 1 and 2 are a sectional view and a plan view, respectively, of a centering ring of an incandescent lamp according to the invention.
Figure 2:
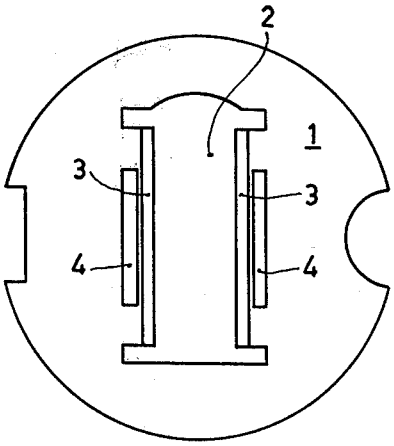

The centering ring shown in FIGS. 1 and 2 consists of a 0.8 mm thick metal sheet. It has a rectangular recess 2 which has been formed by forcing out two flaps 3. The centering ring furthermore comprises two slots 4 which immediately adjoin the flaps 3.

Figure 3:
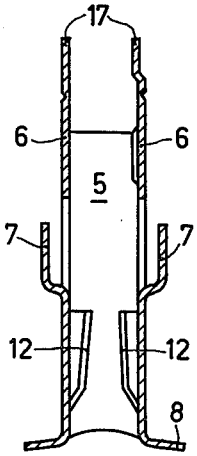
FIGS. 3 and 4 are also a sectional view and a plan view, respectively, of a lamp cap of an incandescent lamp according to the invention.
Figure 4:
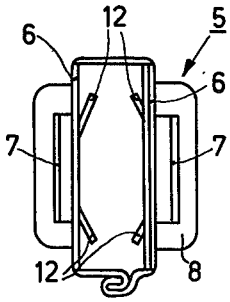
Figure 5:
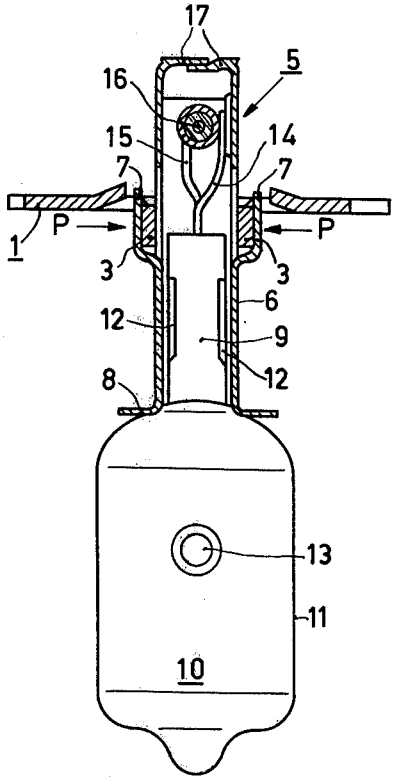
FIG. 5 is a longitudinal sectional view through an incandescent lamp according to the invention.

This centering ring 1 is mountable on a lamp cap 5 shown in FIGS. 3 and 4 which consists of 0.25 mm thick sheet. On the side walls 6 of the cap 5 two hook-like side flaps 7 are forced out which upon mounting the centering ring 1 engage in the slots 4 of the centering ring via the flaps 3 of the centering ring (FIG. 5) so that flaps 3 abut respective side flaps 7.

The cap 5 which has an end flange 8 is rigidly fixed to the pinch 9 of an incandescent lamp 10, the end flange 8 bearing on the envelope 11 of the incandescent lamp 10. Reference numeral 12 denotes a few lugs forced inwardly from the walls of the cap 5 and serving to hold the pinch 9.

Figure 6:
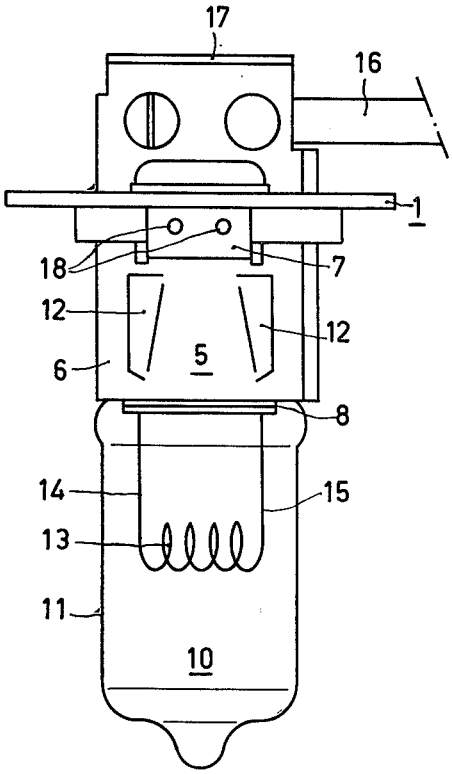
FIG. 6 is a side elevation of the lamp shown in FIG. 5 in a position rotated 90° about its longitudinal axis.

The centering ring 1 mounted on the cap 5 of the incandescent lamp 10 and the filament 13 are aligned with respect to each other in an optical alignment equipment in that the centering ring 1 and the incandescent lamp 10 are moved with respect to each other so that the filament 13 becomes located in an accurately defined position with respect to the centering ring 1. In this position, welding electrodes are applied to the points denoted by P and the flaps 3 of the centering ring 1 are fixed to the side flaps 7 of the cap 5 by spot-welding. The spot-welds are denoted by 18 in FIG. 6. The actual-spot welding process is very short and lasts for example only 0.2 of a second so that the time a lamp occupies the alignment equipment is only very slightly greater than the time taken for alignment.

After connecting one current supply conductor 14 of the filament 13 to a side wall 6 of the cap and after connecting the other current supply conductor 15 to a connection wire 16 which is passed out, two cover flaps 17 of the cap 15 are bent inwards so that the cap 5 is closed.

What is claimed is:

1. An electric incandescent lamp which comprises:

a metallic lamp cap having a portion having a generally rectangular cross-section and having first and second upstanding flaps disposed proximate and parallel to opposed sides of said generally rectangular cross-section, and a metal centering ring having a generally rectangular aperture dimensioned and configured for engagement with said generally rectangular cross-section of said cap, said ring including third and fourth flaps depending from said ring and disposed respectively proximate and parallel to opposed sides of said rectangular aperture, said first and second flaps respectively engaging the outer surfaces of said third and fourth flaps, said third and fourth flaps being disposed with their inner surfaces abutting said generally rectangular cross-section of said cap.

2. The apparatus as described in claim 1 wherein said centering ring includes first and second slots disposed in generally parallel relationship to said third and fourth flaps which are more remotely spaced from said generally rectangular aperture than said third and fourth flaps, said first and second flaps respectively engaging said first and second slots.

3. The apparatus as described in claim 2 further including a spot weld connection between said first and third flaps and also between said second and fourth flaps.

4. The apparatus as described in claim 3 wherein said centering ring is a thicker metal than the metal of said cap.

* * * * *